United States Patent [19]

Schubart

[11] 4,128,375

[45] Dec. 5, 1978

[54] APPARATUS FOR PRODUCING PLATES AND SIMILAR ARTICLES

[75] Inventor: Rolf E. R. Schubart, Kochel am See, Germany

[73] Assignee: Dorst-Keramikmaschinen-Bau Otto Dorst u. Dipl.-Ing. Walter Schlegel, Kochel am See, Germany

[21] Appl. No.: 803,610

[22] Filed: Jun. 6, 1977

[30] Foreign Application Priority Data

Jun. 16, 1976 [DE] Fed. Rep. of Germany ..... 2627160

[51] Int. Cl.[2] ..... B30B 5/02; B30B 5/04; B30B 11/04; B28B 7/26; B28B 3/02

[52] U.S. Cl. ..... 425/405 H; 425/389; 425/DIG. 19

[58] Field of Search ..... 425/388, 389, 405 R, 425/405 H, DIG. 48, DIG. 19

[56] References Cited

U.S. PATENT DOCUMENTS

| | | | |
|---|---|---|---|
| 2,644,198 | 7/1953 | Crawford | 425/DIG. 19 |
| 3,172,927 | 3/1965 | Mojonnier | 425/388 X |
| 3,265,265 | 8/1966 | Levi | 425/DIG. 48 |
| 3,308,213 | 3/1967 | Carrigan et al. | 425/388 X |
| 3,427,687 | 2/1969 | Miller | 425/388 X |
| 3,470,284 | 9/1969 | Hartmann | 425/389 X |
| 3,477,096 | 11/1969 | Bowles et al. | 425/405 H |
| 3,546,740 | 12/1970 | Johnson | 425/389 X |
| 3,605,193 | 9/1971 | Rogiers | 425/388 X |
| 3,664,799 | 5/1972 | Wallick et al. | 425/DIG. 19 |
| 3,705,248 | 12/1972 | Hill et al. | 425/405 R X |
| 3,832,100 | 8/1974 | Baxendale | 425/405 H X |

*Primary Examiner*—J. Howard Flint, Jr.
*Attorney, Agent, or Firm*—Price, Heneveld, Huizenga & Cooper

[57] ABSTRACT

The rigid top pressing punch of a press for producing plates or the like is shaped in accordance with the inner shape of the plate or the like to be produced. An elastic membrane, which establishes the top boundary, i.e., closes the cavity of a mold, is held at its edge shaped to the dimensions of the eventual plate, and is provided with an annular groove corresponding to the foot of the plate. Pulverulent porcelain composition is distributed on the membrane in the area determined by the edge having the holding action structure. The cavity defined by the membrane is filled with a pressure medium. After lowering the pressing punch, pressure can be applied through the pressure medium to the pulverulent porcelain composition distributed on the membrane in a pressing position. The elastic membrane in its relaxed position corresponds to the shape of the lower surface of the plate or the like, is made with an even, minimum thickness over substantially its whole area and has sufficient inherent strength. It can be deformed into a filling position for filling and can be returned into its relaxed starting position during the pressing operation by causing hydrostatic pressure to act against its lower surface.

13 Claims, 6 Drawing Figures

APPARATUS FOR PRODUCING PLATES AND SIMILAR ARTICLES

BACKGROUND OF THE INVENTION

1. Field to Which the Invention Relates

The invention relates to a press for the production of plates and similar articles. It comprises a rigid upper pressing punch, which is shaped in accordance with the interior shape of the plate or the like to be pressed, and with an elastic membrane, which seals the top of the cavity of the mold the membrane is held at its edge corresponding to the dimensions of the eventual plate, and is provided with an annular groove corresponding to the foot of the plate. On this membrane pulverulent porcelain composition is distributed in the limits as determined by the holding action and the cavity is filled under the membrane with a pressure medium, which after lowering the press punch, can place pressure on the pulverulent porcelain composition, distributed on the membrane, in the pressing position of the pressing punch.

2. The Prior Art

In a construction in accordance with German patent specification (Offenlegungsschrift) No. 2,307,496 the membrane is held horizontally perpendicularly to the direction of movement of the upper pressing punch and, on lowering this pressing punch, is deformed downwards to assume the desired eventual shape under the action of the pressure exerted on it. However, it has been found that even if this downward movement is supported from below by suction forces, it is not possible to ensure precisely defined and precisely definable stresses within the membrane, which are transmitted to the pulverulent porcelain composition placed on the membrane. This leads to an irregular plate or similar article. Furthermore on demolding, when the pressed plate or the like becomes detached from the mold because the membrane returns to its initial position, that is to say to its flat position, forces are exerted on the pressed plate or the like, which then has low inherent strength, leading to damage to the plate, at least in its foot part, even if they do not result in complete destruction of the plate or the like.

SUMMARY OF THE INVENTION

One aim of the present invention is that of improving the prior art press so that it is possible to produce and remove satisfactorily pressed plates or the like.

In order to achieve these and other aims the invention provides that the elastic membrane corresponds in its relaxed condition to the shape of the lower surface of the plate or the like, is of the same thickness over substantially its whole area and is made as thin as possible. However, the elastic membrane has sufficient inherent stability to be deformed by filling into a filling condition and when pressing has taken place returns to its relaxed initial position due to the action of hydrostatic pressure on its lower surface.

A press constructed and operated as indicated is capable of being used practically irrespective of the shape of the plate or the like to be pressed, that is to say, irrespective of whether it is a flat or bowl shaped plate or the like.

For pulverulent porcelain compositions which can easily be blown and have a low bulk density, there is a danger that when the upper press punch is lowered there is a blowing out of the pulverulent porcelain composition, and there occurs an uneven wall thicknesses, particularly at the rim of a plate or the like. It can be advantageous, in accordance with a further development of the invention to surround the upper pressing punch by a resiliently mounted ring, which on downward travel of the upper pressing punch, comes to rest on the rim, surrounding the membrane, of the mold and accordingly prevents any blowing out of the pulverulent porcelain composition from the space between the upper pressing punch and the membrane.

At the contact surfaces between this ring and the upper pressing punch it is convenient to provide grooves, which cooperate in forming a hollow annular cavity, which if required can be placed under vacuum.

It is advantageous to arrange the machine in such a manner that when the ring comes to engage the rim, surrounding the membrane, of the mold, the vacuum connection is connected with the whole mold cavity and is then automatically switched off on further lowering of the upper pressing punch as soon as the two grooves are displaced one over the other.

The membrane is preferably provided at its rim with a hook-shaped cross-section in the form of a lip, into which the rim of an insert of the mold can fit. The whole arrangement is then capable of being fixed by mounting a ring, surrounding the membrane provided with a step, on the upper surface of the mold. After detachment of this ring, which can be held with a few screws on the upper surface of the mold, the membrane can readily be removed. If the shape of the plate or the like to be pressed is to be changed the membrane can be replaced by a membrane with a suitably different shape or, if wear should have occurred, it can be replaced by a new membrane.

Before the lowering of the upper pressing punch and after deformation of the membrane into its filling position in accordance with a further development of the invention, a dressing member is caused to act on the top side of the material used for filling and it so shapes the top surface of the material that the desired filling height is achieved, which is determined by taking into consideration the filling ratio and the shape of the article to be produced. The filling ratio is in this respect to be understood to mean a ratio between the volume of the material before the pressing operation and the volume of the plate or the like article after pressing.

In the case of the production of flat plates or similar flat molded articles in accordance with a further embodiment of the invention, the profile of the insert of the mold corresponds to the membrane on filling in the pulverulent ceramic material. It is convenient to provide channels in the insert, which not only supply the pressure medium to the hydraulic presses but also cause the membrane to lie snugly on top of the insert by removing the pressure medium. The removal of the pressure medium is carried out using a substantial degree of vacuum, such as, for example 0.3 to 0.4 atmospheres. Under this suction action the membrane rests snugly on the top profile of the insert but, however, in the vicinity of the supply channels space is still left which makes it possible for the pressure medium to be applied to the lower surface of the membrane on application of the hydrostatic pressure.

If there is an angle at any position in the filling profile which is greater than the angle of repose of the composition to be pressed then there is employed a further development of the invention which is also suitable for the manufacture of flat plates or the like. However, in such a case its use would only give rise to a somewhat more complex construction without its use being necessary.

In accordance with this modified embodiment of the press in accordance with the invention, the insert is subdivided into an outer part and an inner part which, unlike the outer part, can be vertically adjusted and which, for example in the form of a plate, lies against the central lower part of the membrane. This lower part must be capable of being shifted, preferably against the force of a spring and the shifting displacement can be chosen so as to be adjustable.

In the filling condition, the inner part is raised as compared with the outer part of the insert. As a result the membrane is raised out of its resting position, which is the same as the pressing position, into a pre-stressed position, which is equivalent to the filling position. The filling and dressing of the top surface of the filled in pulverulent porcelain composition so as to be smooth is carried out in the same manner as that described in the preceding described form of embodiment.

After the filling the lower part is pressed downwards against the action of the spring acting upon it by the upper pressing punch via the pulverulent porcelain composition. When this is done the membrane is also moved out of its pre-stressed position into its relaxed rest position, which corresponds to the pressing position.

In this position the pressure medium is caused to act against the lower side of the membrane.

In this manner it is possible to ensure reliably that in the case of plates or the like, which have parts having a steep angle above the angle of repose, the composition does not slide inwards, because even on causing the upper pressing punch to come into position the composition is trapped between this pressing punch and the membrane.

With this design it is readily possible to change over from one type of plate to another type of plate. It is only necessary to provide for vertical adjustability of the inner part, replacement of the membrane by another one and naturally also replacement of the profile of the upper pressing punch and of the pressing device without the basic design of the press itself having to be subject to any modifications.

In the case of the last mentioned embodiment, an effect which occurs with normal presses operating with hydrostatic counter-pressure, the so-called "water bed effect," is completely avoided. When this effect does occur, application of the pressure by the upper pressing punch sometimes causes the liquid to move out of the way unevenly and the result is uneven pressing within the plate or the like. In the case of the press constructed in accordance with the first embodiment of the invention there is a precisely defined position of the membrane in the filling position even though the flat part of the plate or the like is not supported as in the case of the second embodiment.

In the case of the first described embodiment, this "water bed effect" does not occur in principle because in this case in the filling position on dressing the composition the membrane is supported over its whole lower surface.

The invention will now be described with reference to the accompanying drawings.

LIST OF FIGURES OF THE DRAWINGS

Figure 1:
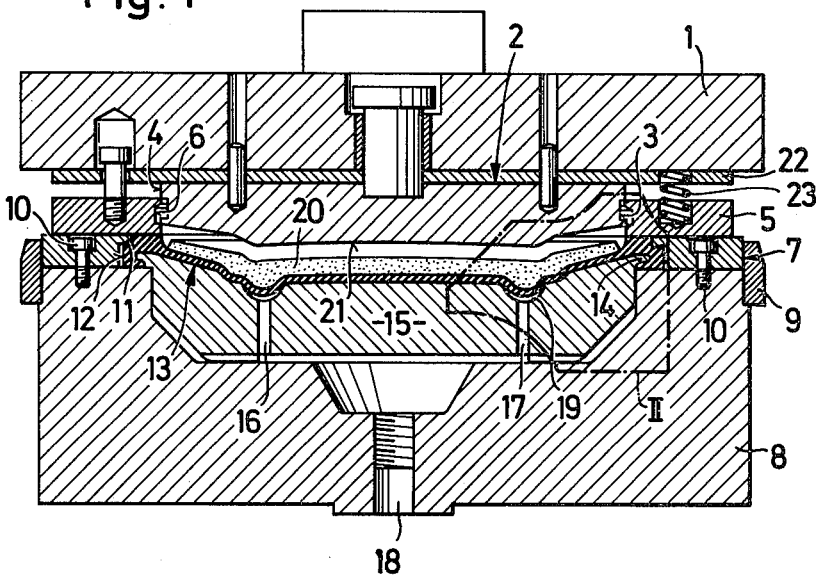
FIG. 1 shows a vertical section through the upper pressing punch and the mold in the case of a press embodying the invention in the filling position.

In FIG. 1 reference numeral 1 denotes the tup, which at its lower edge, has the upper pressing punch 2 attached to it in a removable manner. This pressing punch 2 has, at its rim, a peripheral groove 3. The rim 4 of the pressing punch 2 moves into a ring 5 carried resiliently on the pressing punch 2 (at 23). This ring 5 is also provided with a peripheral groove 6, which cooperates with the peripheral groove 3. The annular duct or channel so formed by the annular grooves 3 and 6 can be brought into connection with a source of vacuum, not shown in the drawings, in a manner which is not shown via the upper pressing punch 2 or via the ring 5. The ring 5 comes to rest on a ring 7 on lowering the upper pressing punch 2. The ring 7 lies on the mold 8 which in turn is carried by the press frame which is not shown. The ring 7 is held in place by a further ring 9 and can, for example, also be attached by means of screws 10 to the mold 8. The ring 7 has a projection 11, more particularly indicated in FIG. 2, which fits over an outer rim 12 of the membrane 13. The rim 12 is so constructed that it has a hook-shaped cross-section, into which the edge 14 of an insert 15 fits. The upper surface of this insert 15 defines the filling position of the membrane 13. Membrane 13 is supported practically over its whole lower surface on the upper surface of the insert 15 and it is only in the vicinity of the outlet of channels 16 and 17, which are connected with a central duct or channel 18, that a small space 19 (see FIG. 2) is provided, which makes it possible for the supply of the pressure medium to become distributed over the whole lower surface of the membrane.

Figure 3:
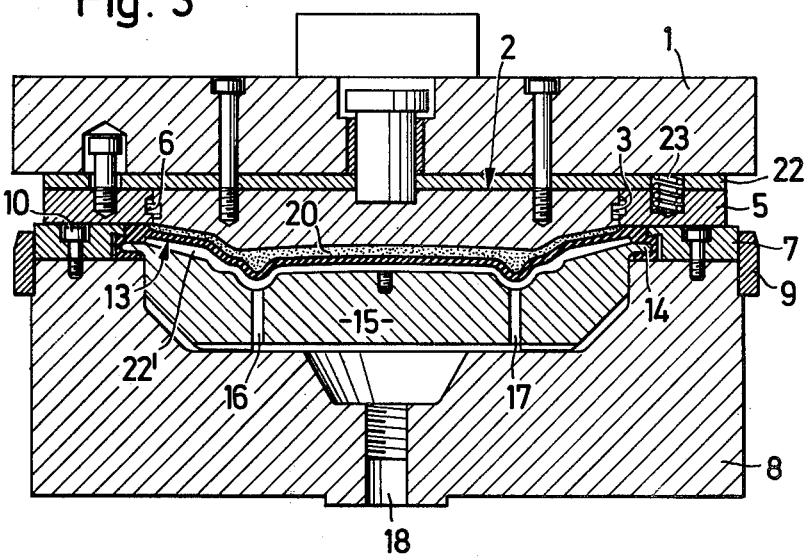
FIG. 3 shows the press in accordance with FIG. 1 in the pressing position.

For filling the press, first, vacuum is connected to the channels 16 and 17 via the channel 18 so that the membrane 13, which in its relaxed condition has its upper surface in a shape practically identical with the lower surface of the plate or the like to be pressed, is deformed and brought into engagement with the insert 15. Then the pulverulent porcelain composition 20 to be pressed is filled in a conventional manner which is not shown and described in detail, and with the aid of a dressing member, also not shown in detail, is distributed in accordance with the desired filling height generally in accordance with the shape of the lower surface 21 of the pressing punch 2 on the membrane 13 which is pre-stressed into the filling position. The pressing punch 2 is then moved downwards with the help of the tup 1 until the ring 5 comes to rest on the ring 7 and then the rim 22 comes to rest on the ring 5 so that the spring 23 is compressed. Following this the mold is closed and completely sealed off from the outside (FIG. 3). By applying vacuum to the annular channel formed by the two grooves 3 and 6 it is possible to provide for a substantial removal of air from the space, located under the lower pressing punch, before the two grooves 3 and 6 are shifted one over the other.

Now pressure medium is supplied via the channel 18 and the channels 16 and 17 so that the membrane 13 is moved clear of the insert 5 in the manner indicated in FIG. 3 and is returned into its relaxed initial condition. When this is done the space 22 is filled with pressure medium and the pressure medium acts completely evenly on the lower surface of the membrane 13 so that the pulverulent porcelain composition 20 is pressed evenly against the lower surface 21 of the pressing punch 2. It is thus possible to ensure that an evenly compacted plate is produced. In the present embodiment of the invention a flat plate is produced.

To open the press, it is not only necessary to release the pressure in the space 22 and the channels 16, 17 and the supply channel 18 but also to apply a vacuum again so that the membrane 22 returns to its pre-stressed filling and initial position, releases the pressed plate or the like and can be charged with pulverulent porcelain composition 20 again.

Figure 4:
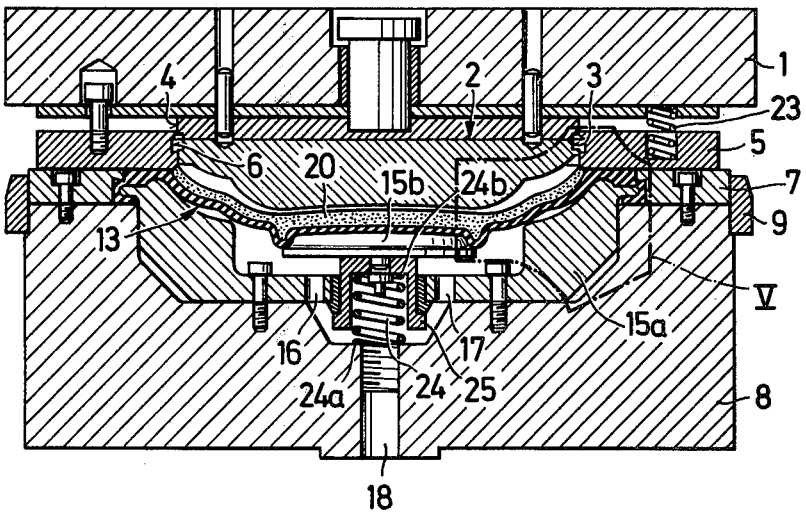
FIG. 4 shows a modified form of the press for pressing deep bowled plates substantially in accordance with the section of FIG. 1.
Figure 5:
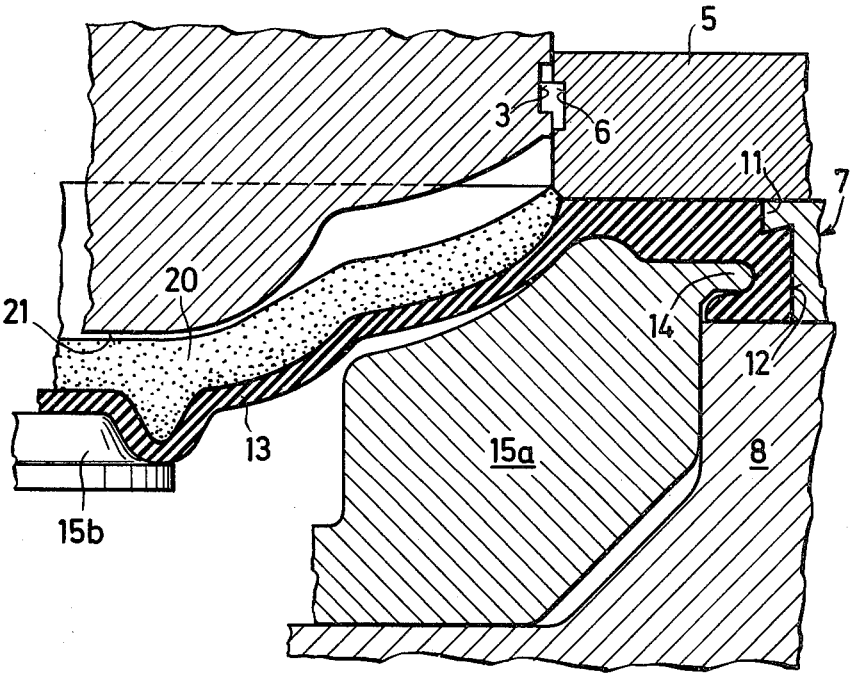
FIG. 5 shows a part of the construction of FIG. 4 in accordance with the portion indicated by the line V in FIG. 4.
Figure 6:
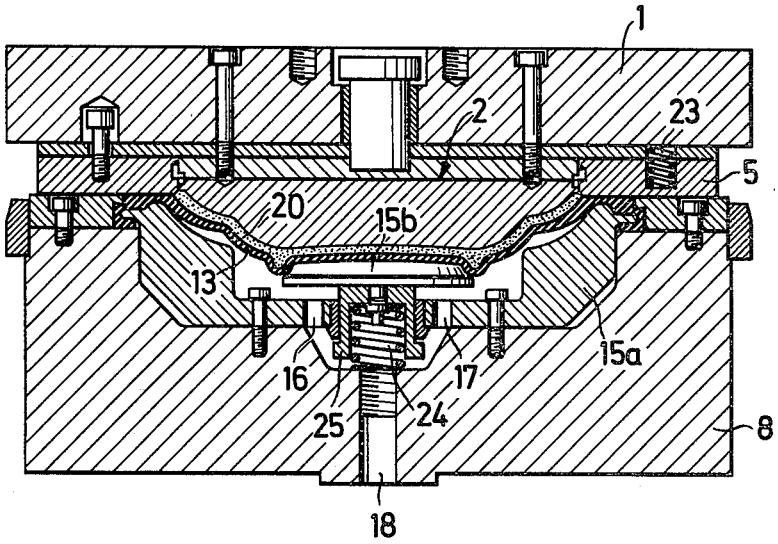
FIG. 6 shows the arrangement in accordance with FIG. 4 in the pressing position.

In the embodiment of the invention shown in FIGS. 4 to 6 the insert is subdivided into two parts, that is to say an outer part 15*a* screwed on to the mold 8 and an inner part. The inner part has, in the case of the embodiment illustrated, the shape of a plate or platen 15*b*, which comes to rest against the inner lower part of the membrane 13. Furthermore the plate 15*b* can be moved against the force of a spring 24, which has one end 24*a* resting against the mold 8 while its other end 24*b* rests against a hood-shaped sleeve 25 which surrounds it and is attached to the platen 15*b*. The construction of the upper pressing punch 2 is selected in accordance with the desired shape of the plate or the like. Its attachment to the tup 1 is just the same as with the pressing punch 2 on the tup 1 in accordance with FIGS. 1 to 3 so that a more detailed explanation is not called for.

Figure 2:
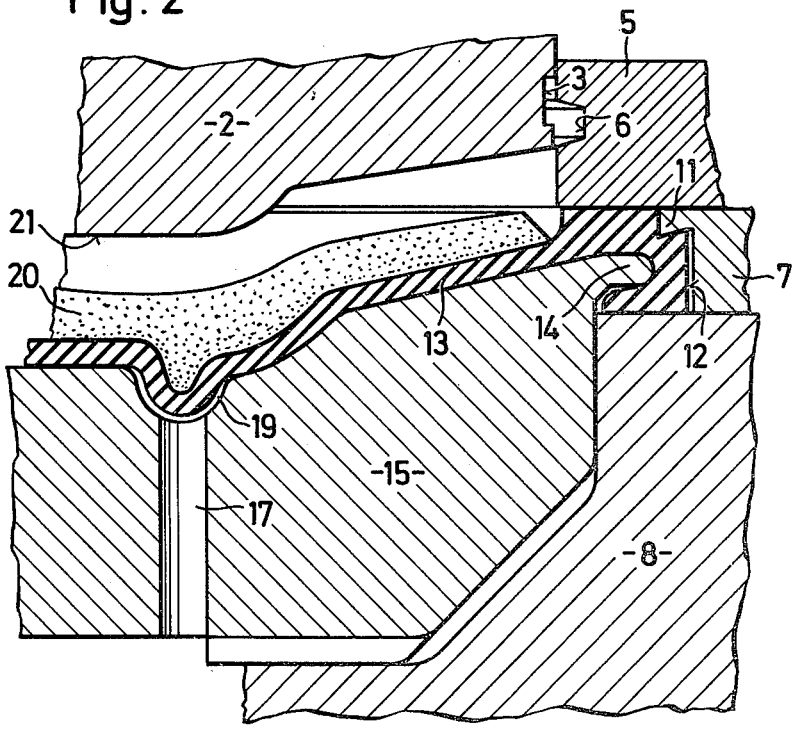
FIG. 2 shows a part of the construction in accordance with FIG. 1 as delimited by the line II in FIG. 1.

Furthermore the attachment of the membrane by means of the insert, consisting in this case of two parts 15*a* and 15*b*, using the rings 7 and 9 is entirely in accord with the design in accordance with FIGS. 1 to 3 so that in this respect as well it is not necessary to provide a repetition of the explanation.

In the filling position as shown in FIG. 4 the membrane 13 is deformed by means of the platen 15*b* under the action of the spring 24 out of its relaxed condition corresonding to the final shape of the plate or the like to be produced, as can be seen clearly from FIG. 4.

It is in this pre-stressed condition of the membrane 13 that the filling and dressing of the pulverulent porcelain composition occurs as was indicated in conjunction with FIGS. 1 to 3 though in the present case this filling operation is not explained and shown in detail. After the filling operation the tup 1 and accordingly also the upper pressing punch 2 are lowered and the platen 15*b* is pressed downwards against the action of the spring 24 acting on it, by the upper pressing punch 2 via the pulverulent porcelain composition. When this is done the membrane is also moved out of its pre-stressed filling position into its relaxed resting condition which corresponds to the pressing position as shown in FIG. 6. In this position the pressure medium can be caused to act on the lower side of the membrane 13 in the manner described in conjunction with FIGS. 1 to 3 via the channel 18 and the channels 16 and 17 which, in the present case, are suitably shortened. Owing to the raising of the membrane into the filling position as is indicated in FIG. 3, it is therefore possible to ensure reliably that in the case of plates or the like which have parts so steeply angled as to lie above the angle of repose, the composition does not slide inwards because, even when the upper pressing punch 2 comes into position, the composition is trapped between the pressing punch 2 and the membrane 13.

It is to be pointed out once again that the membrane is to be made of the same uniform minimum thickness over substantially its whole area though, however, it should have a sufficient inherent stability or strength.

I claim:

1. A press for the production of articles of low silhouette such as plates including:

a mold having a cavity;

a rigid upper pressing punch having a lower profile shaped in accordance with the interior shape of the article to be pressed and adapted for downward travel toward said cavity;

an elastic membrane having a peripheral rim, said elastic membrane sealing the top of said cavity of said mold and secured at said rim, said membrane having a recess therein corresponding to the shape and dimensions of the article to be pressed for receiving a pulverulent porcelain composition, said membrane including an annular groove for shaping the foot of the plate, said elastic membrane having a relaxed position with a shape corresponding to the shape of the lower surface of the article, and being of substantially uniform thickness, which thickness is sufficient that it can be deformed for filling with the pulverulent material and return to its relaxed position;

means providing a source of vacuum connected to said cavity for drawing said membrane downwardly into said cavity to position it for receipt of said pulverulent material;

means providing a source of fluid pressure connected to said cavity for applying pressure to said membrane and the pulverulent porcelain composition on said membrane when said pressing punch is lowered on the pulverulent porcelain composition for deflecting the membrane to press the pulverulent material against said punch;

a resiliently mounted ring surrounding said upper pressing punch, said ring seating on the membrane rim when the punch moves to closed position, said ring and said upper pressing punch having opposing contact surfaces, each of said contact surfaces having opposing grooves which together form a hollow annular cavity, a said means providing source of vacuum communicating with said annular cavity;

an insert for the mold having means at its inner edge interfitting with the rim of said membrane;

a securing ring for securing said insert rim in said lip, said securing ring surrounding said membrane and including a step for fitting over the peripheral portion of the upper surface of the rim of the membrane;

fluid passage channels through said insert;

a residual space in the top profile of the insert in the vicinity of the channels for exposing the membrane to the vacuum when the same is applied to said insert channels to draw the membrane snugly against the top profile of the insert; and said insert having outer and inner parts, said inner part being adjustable vertically and including a platen which rests against the central lower part of said membrane, thereby facilitating molding of angled sides of the article spring urging said inner part into raised position.

2. A press as recited in claim 1 wherein said inner part positioned against the bottom of said membrane and has a lower surface exposed to fluid under pressure whereby said inner part exerts an upward force on said membrane during the period the pulverulent material is being pressed.

3. A press as recited in claim 2 further comprising a hooded sleeve enclosing an upper portion of said spring and engaging the bottom portion of said inner part of said insert.

4. A press as recited in claim 1 wherein said resiliently mounted ring is endless and includes springs for mounting said ring thereby permitting relative movement between said ring and said upper punching press.

5. A press for the production of plates or the like from a pulverulent porcelain composition, said press having a rigid upper press member having a lower face shaped in accordance with the interior shape of the object to be formed, a mold having an upwardly opening cavity, said cavity shaped in accordance with the peripheral shape of the object to be formed; a thin elastic membrane of substantially uniform thickness and in its relaxed state having the general shape and contour of the bottom of the article to be formed, said membrane closing the upper face of said cavity for receiving a layer of porcelain material thereon, means providing a source of vacuum connected to said cavity below said membrane for drawing said membrane downwardly to a porcelain material receiving position; means providing a source of positive fluid pressure connected to said cavity beneath said membrane for deflecting said membrane upwardly and compressing the porcelain material against the lower face of said upper press member and said membrane being capable of returning to its original position upon termination of positive fluid pressure in said cavity for releasing the article formed thereon.

6. A press for the production of articles of low silhouette such as plates from pulverulent material, said press comprising: a rigid upper pressing punch, the lower face of which is shaped in accordance with the interior shape of the article to be pressed, a press bed having an upwardly opening cavity below and aligned with said punch; an elastic membrane seated over and sealing the top of the cavity, said member being secured at its edge and having an upwardly opening recess terminating in an upwardly extending shoulder adjacent the edge of the membrane, said shoulder defining the periphery of the area for receiving pulverulent porcelain material, said membrane in its relaxed condition having a shape corresponding substantially to the bottom of the finished article and being of substantially uniform cross-section and of sufficient resilient strength to assume its relaxed position even though loaded with an article which has been pressed to shape; means providing a source of vacuum connected to said cavity beneath said membrane for pulling said membrane partially into said cavity in preparation for placement of the porcelain material on top of said membrane; means for lowering the press punch against the top of said press bed; and means providing a source of fluid under pressure connected to said cavity for forcing said membrane upwardly to compress and compact the pulverulent material between the membrane and the punch; said elastic membrane in its relaxed position and its lowered position when subjected to vacuum and in its raised position when under pressure having substantially the cross-sectional shape of the article to be formed and being of substantially uniform thickness throughout.

7. A press as described in claim 6 including an endless ring and means for mounting said ring on and surrounding said upper punch, said mounting means having resilient elements supporting said ring below said punch, said ring resiliently pressed against the periphery of the membrane of the mold as the punch moves toward the membrane.

8. A press as described in claim 7 wherein the punch has an annular exterior groove and the ring has an annular groove opening through its inner face; one of said grooves being connected to said means providing a source of vacuum; said grooves cooperating with each other to connect the space between the lower face of said punch and the upper face of said membrane to said source means of vacuum; said grooves also moving past each other to form a shut-off valve isolating said space from said vacuum source means as said punch moves through said ring while the resilient mounting for the ring is compressed.

9. A press in accordance with claim 7 further characterized in that said punch slides through said ring and the surfaces in contact between the ring and the punch are provided with grooves which together form a hollow annular cavity; said source of vacuum means being connected to said cavity, said cavity during a portion of the movement of said punch being in communication with the area above said membrane for evacuating the same.

10. A press in accordance with claim 9 further characterized in that the arrangement is such that when the ring seats against the periphery of the membrane, the vacuum source means is connected to the space above the membrane and is then automatically shut off on further lowering of the punch by displacement of the two grooves with respect to each other.

11. A press in accordance with claim 10 further characterized in that the lower end of said cavity is closed by an insert having a channel corresponding to a foot forming groove in the membrane and said vacuum source means is connected to said channel for drawing the membrane snugly against all of the top profile of the insert except the channels, the residual space at the channels providing a means for distributing the fluid under pressure beneath the entire lower side of the membrane.

12. A press in accordance with claim 11 further characterized in that the insert has an outer part and an inner part; the inner part being vertically adjustable with respect to the outer part and seats against the central lower part of the membrane.

13. A press in accordance with claim 12 further characterized in that the inner part is resiliently supported by a spring.

* * * * *